US011420090B2

(12) United States Patent
Stepanian et al.

(10) Patent No.: US 11,420,090 B2
(45) **Date of Patent: *Aug. 23, 2022**

(54) BI-DIRECTIONAL RESISTANCE EXERCISE MACHINE

(71) Applicants: Robert Stepanian, Oak Hills, CA (US); Elizabeth Coddington, Oak Hills, CA (US)

(72) Inventors: Robert Stepanian, Oak Hills, CA (US); Elizabeth Coddington, Oak Hills, CA (US)

( * ) Notice: Subject to any disclaimer, the term of this patent is extended or adjusted under 35 U.S.C. 154(b) by 95 days.

This patent is subject to a terminal disclaimer.

(21) Appl. No.: 16/815,252

(22) Filed: Mar. 11, 2020

(65) Prior Publication Data

US 2020/0206565 A1 Jul. 2, 2020

Related U.S. Application Data

(62) Division of application No. 15/908,310, filed on Feb. 28, 2018, now Pat. No. 10,596,408.

(51) Int. Cl.
*A63B 22/00* (2006.01)
*A63B 21/00* (2006.01)
(Continued)

(52) U.S. Cl.
CPC .... *A63B 22/0076* (2013.01); *A63B 21/00069* (2013.01); *A63B 21/00192* (2013.01); *A63B 21/015* (2013.01); *A63B 21/0435* (2013.01); *A63B 21/154* (2013.01); *A63B 21/225* (2013.01); *A63B 21/4034* (2015.10); *A63B 21/4035* (2015.10); *A63B 21/4045* (2015.10); *A63B 22/0046* (2013.01);
(Continued)

(58) Field of Classification Search
CPC ..... A63B 21/22–227; A63B 22/0046; A63B 22/0076; A63B 21/00069; A63B 21/00192; A63B 21/015; A63B 21/0435; A63B 21/154; A63B 21/4034; A63B 21/4035; A63B 21/4045; A63B 2225/093; A63B 2022/0035; A63B 2022/0079
See application file for complete search history.

(56) References Cited

U.S. PATENT DOCUMENTS 2,783,045 A 2/1957 Bosch
3,572,701 A 3/1971 Agamian
(Continued)

FOREIGN PATENT DOCUMENTS

DE 202015102094 5/2015
WO 2004004845 1/2004

*Primary Examiner* — Jennifer Robertson
(74) *Attorney, Agent, or Firm* — Buche & Associates, P.C.; John K. Buche; Bryce A. Johnson

(57) ABSTRACT

Disclosed is a bi-directional resistance exercise machine. The bi-directional resistance exercise machine is comprised of two flywheels that provide constant and variable resistance against the movement of a trolley during a push or pull movement. The bi-directional resistance allows a user to work antagonistic muscles in an efficient manner and in one single machine. Accordingly, the present invention provides resistance against a user while pulling a trolley along a track to work the core, legs, back, and biceps, and resistance against a user while pushing a trolley along a track to work the core, chest, triceps, and shoulders.

19 Claims, 8 Drawing Sheets

(51) Int. Cl.
*A63B 21/22* (2006.01)
*A63B 21/015* (2006.01)
*A63B 21/04* (2006.01)

(52) U.S. Cl.
CPC ..... *A63B 2022/0035* (2013.01); *A63B 2022/0079* (2013.01); *A63B 2225/093* (2013.01)

(56) References Cited

U.S. PATENT DOCUMENTS

| | | | | |
|---|---|---|---|---|
| 3,841,627 | A | 10/1974 | Vetter | |
| 4,700,946 | A | 10/1987 | Breunig | |
| 4,743,011 | A | 5/1988 | Coffey | |
| 4,768,775 | A | 9/1988 | Marshall | |
| 4,798,378 | A | 1/1989 | Jones | |
| 4,921,242 | A | 5/1990 | Watterson | |
| 5,072,929 | A * | 12/1991 | Peterson | A63B 22/0076 482/72 |
| 5,076,573 | A | 12/1991 | Lo | |
| 5,242,351 | A | 9/1993 | Berg et al. | |
| 5,518,483 | A | 5/1996 | Oswald | |
| 6,280,363 | B1 * | 8/2001 | Harrell | A63B 21/005 482/57 |
| 6,682,462 | B1 | 1/2004 | Lee | |
| 7,108,639 | B2 | 9/2006 | Smith et al. | |
| 8,608,631 | B2 | 12/2013 | Mitchell | |
| 10,596,408 | B2 * | 3/2020 | Stepanian | A63B 21/4035 |
| 2002/0187879 | A1 | 12/2002 | Ball et al. | |
| 2005/0277521 | A1 | 12/2005 | Lat | |
| 2008/0020898 | A1 | 1/2008 | Pyles et al. | |
| 2011/0028278 | A1 | 2/2011 | Roach | |
| 2016/0059060 | A1 | 3/2016 | Lagree | |
| 2019/0262661 | A1 | 8/2019 | Stepanian | |

* cited by examiner

PUSH MOTION

BI-DIRECTIONAL RESISTANCE EXERCISE MACHINE

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter is in the field of strength training and fitness.

Background of the Invention

Sports training flywheels incorporate spinning discs to provide continuous repetition of concentric and eccentric movements. Flywheels work in cycles, providing a rapid eccentric rebound following each concentric muscular contraction. Various rowing machines utilize flywheels to provide low-impact strength training for legs, abdominal, upper back, and arm muscles. These machines provide excellent cardiovascular and muscular training, and offer a non-weight bearing exercise apparatus for rehabilitation, endurance, and stamina.

Traditional rowing machines provide one-directional resistance during each rowing motion. The beginning of a rowing motion, the drive, begins with a dynamic leg extension, activating the quadriceps, hamstrings, and gluteus maximus. This movement causes a natural contraction of the abdominal muscles to stabilize the lower back. The pulling motion on the rowing handle completes the rowing motion, activating the biceps and upper trapezius. Once this motion is complete, the body is pulled forward mainly from momentum to reset and relax before initiating another rowing motion.

The single directional resistance focuses largely on the lower body, failing to provide a balanced muscular workout. A machine that requires a pushing movement, rather than allowing momentum, to return to the starting position effectively and simultaneously works opposing muscles groups (agonist and antagonist muscles) including the triceps and pectoral muscles. Workouts that target opposing muscle groups (i.e., chest and back, quads and hamstrings, or biceps and triceps) are more time efficient and may even build more strength that traditional workouts that only focus on an anterior or posterior chain muscle group. An antagonist workout increases muscular balance and increases strength by working opposing muscle groups.

Currently, there exists a magnetic tension weight training machine (U.S. Pat. No. 6,857,993 to Yeh), which discloses a single magnetic flywheel and pulley device that provides resistance for a pulling motion. There also exists rowing machines with resistance in a single direction (i.e. U.S. Pat. No. 5,072,929 to Peterson et al.). However, neither of these machines provide an antagonistic workout that allows a user to perform a pulling and pushing motion on the same unit to workout opposing muscle groups in an efficient manner.

Thus, a need exists for a bi-direction resistance exercise machine that allows a user to efficiently and effectively workout opposing muscles in a series of exercises without needing to leave the seat of a single exercise machine. The present invention provides constant resistance in both pushing and pulling movements, wherein the user can work his or her core, legs, back, biceps, chest, triceps, and shoulders, without needing to adjust a machine or move from a seated position on a machine.

SUMMARY OF THE INVENTION

In view of the foregoing, an object of this specification is to disclose a quad resistance single unit exercise machine that allows for resisted movement in two directions.

In a typical embodiment, the machine utilizes multiple magnetic flywheels to provide resistance to both pushing and pulling movements by varying the distance between strong magnets. The flywheels act as energy reservoirs, supplying lasting mechanical energy through inertia created by a user's concentric movements. Specifically, the magnets provide resistance braking and work to slow down the flywheels, requiring a user's muscles to contract to counteract the resistance to maintain flywheel momentum. The resistance provided by multiple flywheels is active in two directions and demands force from both agonistic pairs of muscles equally, rather than simply providing resistance during concentric movements, as typical flywheel machines operate, and allowing wheel momentum to complete the eccentric movement.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which.

Figure 1:
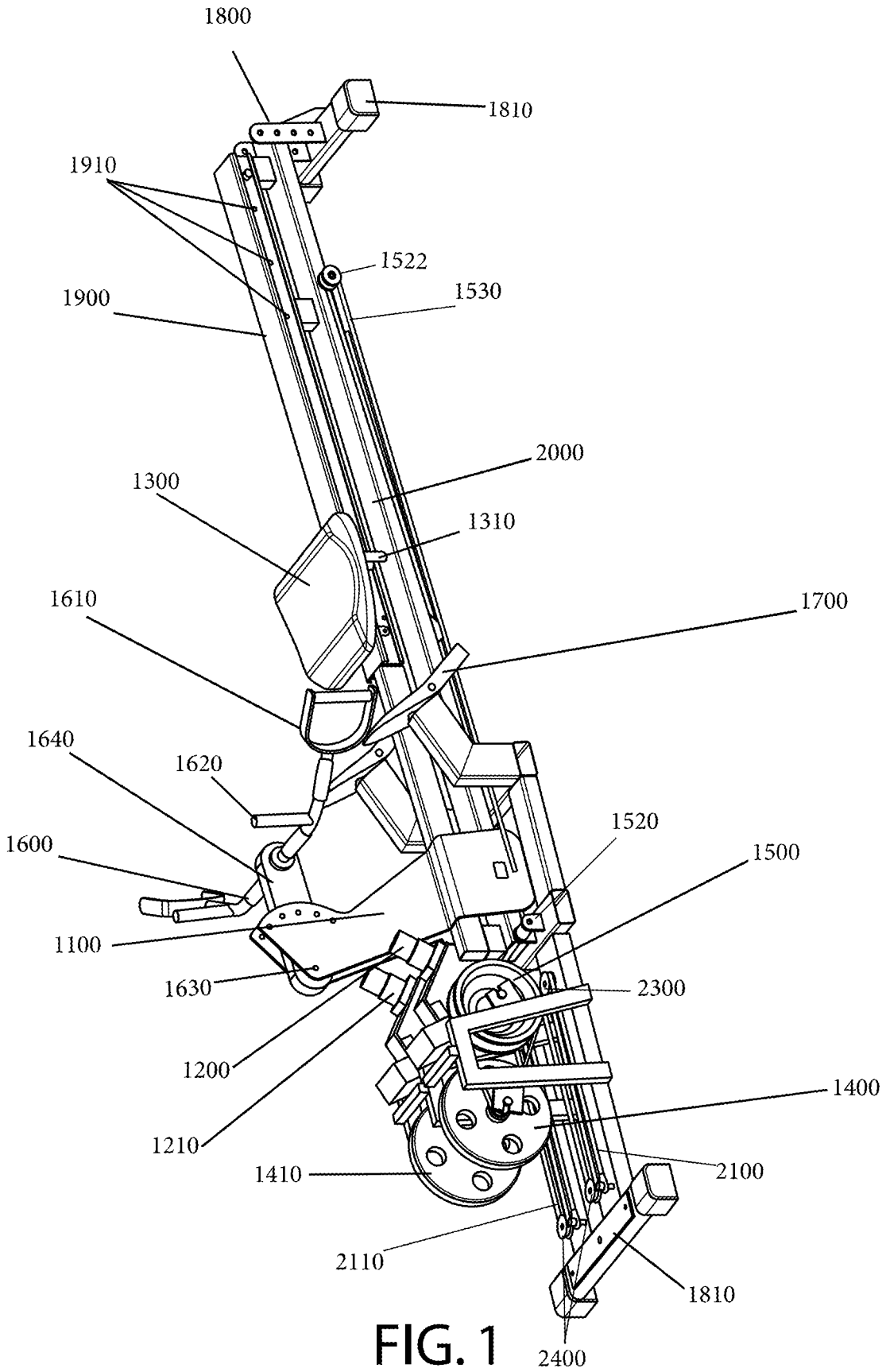
FIG. 1. is a perspective view of one embodiment of the exercise machine.

In the figures, the following reference numerals represent the associated components of the disclosed machine and system:

Trolley—1100;
Trolley Wheels—1110;
First Resistance Knob—1200;
Second Resistance Knob—1210;
Seat—1300;
Seat Securing Pin—1310;
First Flywheel—1400;
Second Flywheel—1410;
First Flywheel Belt—1420;
Second Flywheel Belt 1421;
First Resistance Wheel—1500;
Second Resistance Wheel—1510;
First Front Pulley—1520;
Second Front Pulley—1521;
Rear Pulley—1522;
First Band—1530;
Second Band—1531;
Handlebar Assembly—1600;
Stirrup Handle Grip—1610;
Upright Handle Grip—1620;
Angle Adjuster—1630;
Handlebar Connector—1640;
Foot Bed—1700;
Incline Adjuster—1800;
Stabilizing Foot—1810;
Seat Rail Track—1900;
Seat Rail Track Slots—1910;
Trolley Rail Track—2000;
Recoil System
First Recoil Rope—2100;
Second Recoil Rope—2110;
First recoil pulley—2300;
Second recoil pulley—2400;
Third recoil pulley—2500.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFFERED EMBODIMENTS

Disclosed generally is a bi-directional exercise machine, which features constant and variable resistance for a full body antagonist workout. In use, the machine may be utilized for antagonistic muscular strength training, endurance training, and rehabilitation. The more specific aspects of the disclosed device are described below with reference to the appended figures.

FIG. 1 is a perspective view of the bi-directional exercise machine generally featuring: a resistance unit comprising of a first flywheel 1400, a second flywheel 1410, a first resistance wheel 1500, a second resistance wheel 1510; a recoil system comprising of a first recoil rope 2100, a second recoil rope 2110, and two sets of a first recoil pulley 2300, a second recoil pulley 2400, and a third recoil pulley 2500; a handlebar assembly 1600; a trolley 1100; a seat rail track 1900; a trolley rail track 2000; and trolley rail track belt 2100. Referring to FIG. 1, a seat 1300 is secured to the seat rail track 1900 via a securing pin 1310. The securing pin 1310 may be removed, permitting the seat 1300 to move laterally along the seat rail track 1900. A user may adjust the distance of the seat 1300 in relation to the foot beds 1700 by inserting the securing pin 1310 into a seat rail track slot 1910 at various points along the seat rail track 1900.

The bi-directional exercise machine also features foot beds 1700 to receive the user's feet while performing the exercise. In a preferred embodiment, the foot beds 1700 are further defined by foot straps to aid in securing the foot in place.

Figure 2:
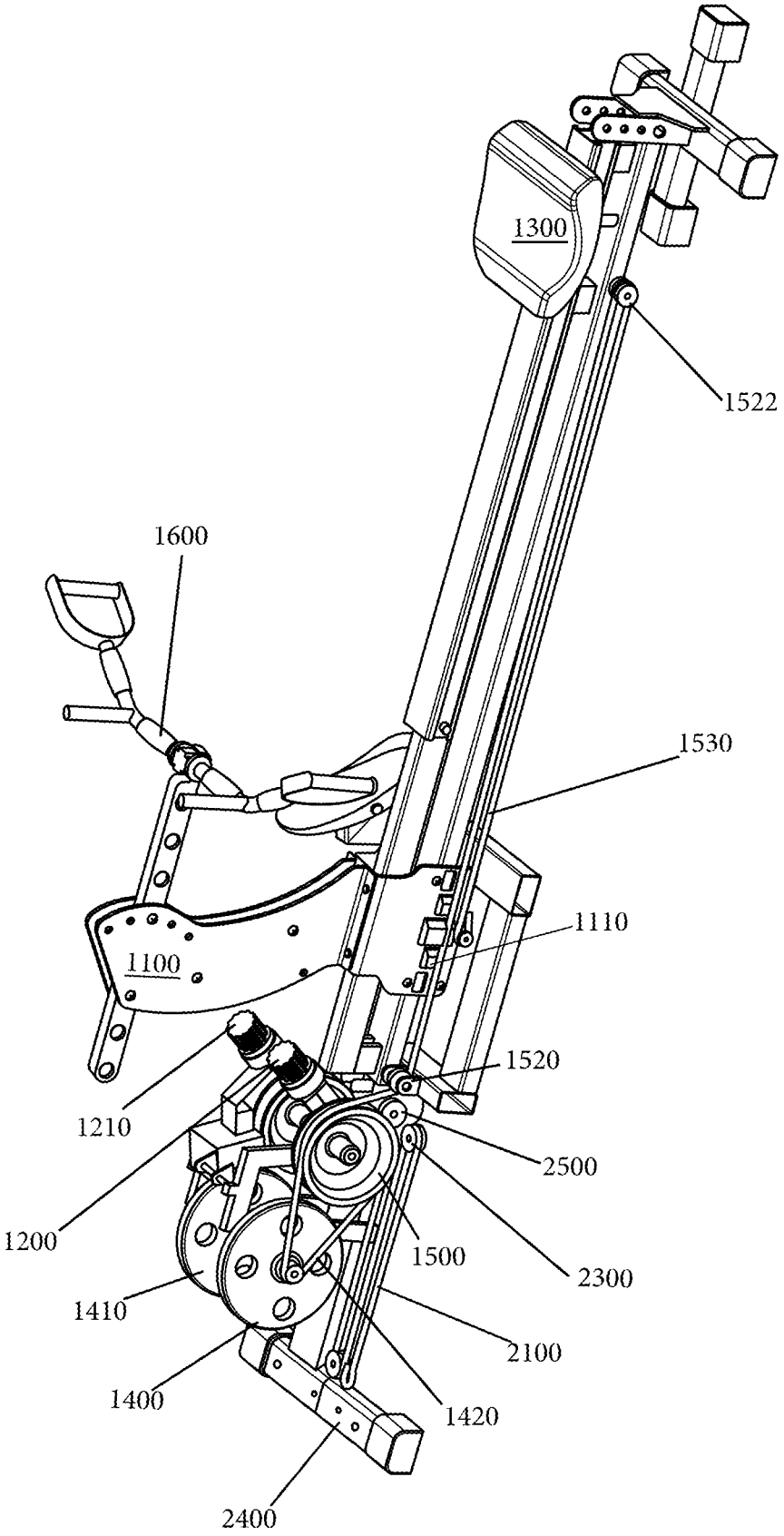
FIG. 2. is a perspective view of an alternative embodiment of the exercise machine with the configuration of the resistance unit and recoil system exposed.
Figure 3:
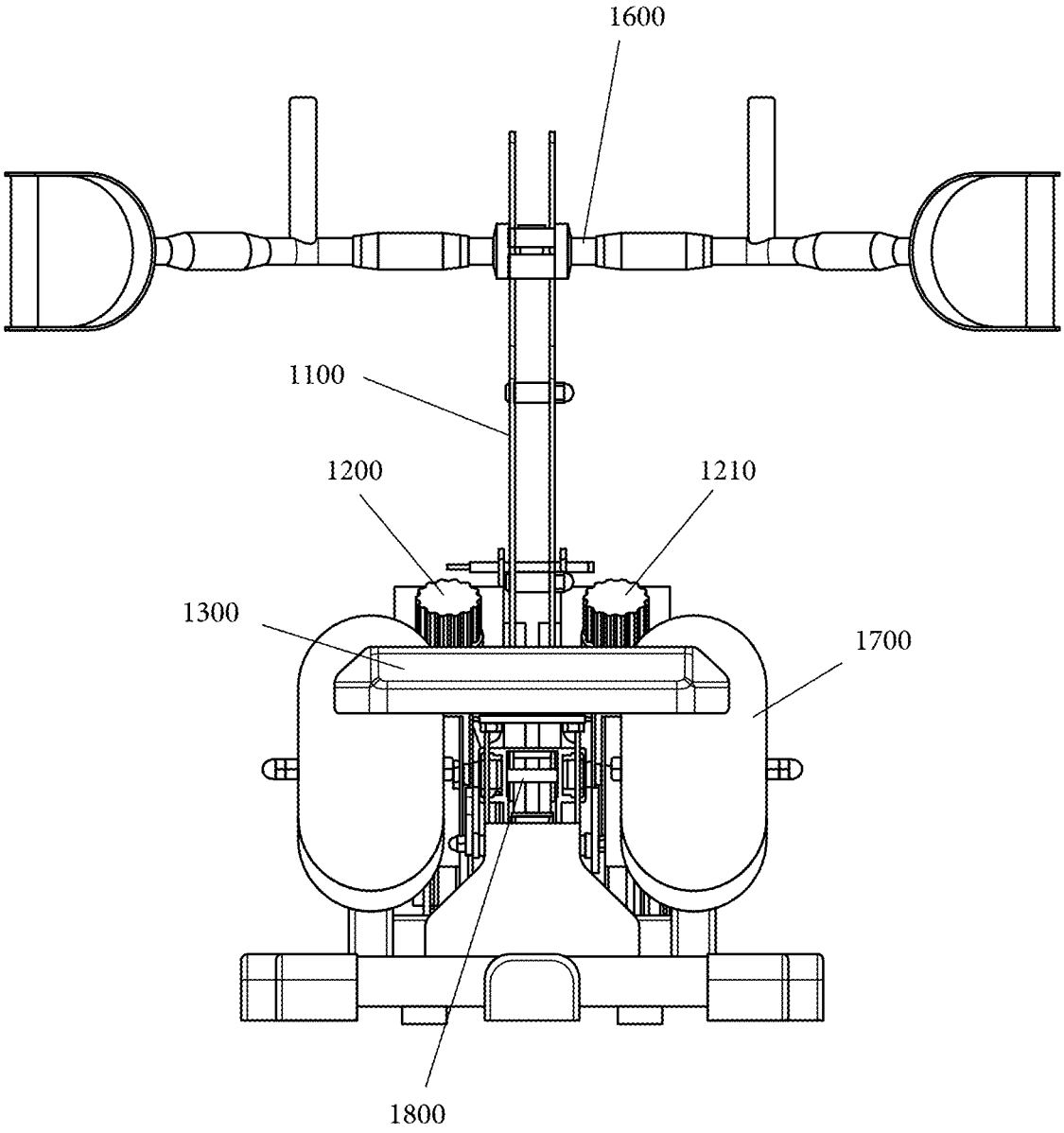
FIG. 3 is a back view of the exercise machine.

FIG. 2 is a perspective view of one embodiment of the bi-directional exercise machine with parts of the stabilizing base removed to expose the resistance unit. FIG. 3 is a back view of the exercise machine. Referring to FIG. 2 and FIG. 3, a user may adjust the incline of the seat 1300 by adjusting the rail tracks 1900, 2000 via the incline adjuster 1800. The trolley rail track 2000 is fixed to the incline adjuster 1800 and the incline adjuster 1800 has a plurality of slots set at different incline levels, wherein a user inserts a pin through a set of holes to lock the tracks 1900, 2000 at a desired incline level. The incline adjuster 1800 and corresponding exercise machine is stabilized on one end by a stabilizing foot 1810 that is fixed perpendicularly to the distal end of the incline adjuster 1800. The stabilizing foot 1810 connects the ground to balance and minimize excess side to side or front to back movement of the exercise machine. By adjusting the incline, a user can make an exercise more or less difficult depending on the incline level that is selected. In an alternative embodiment, the seat 1300 may feature a back rest suitably configured to support a user's back.

Figure 4:
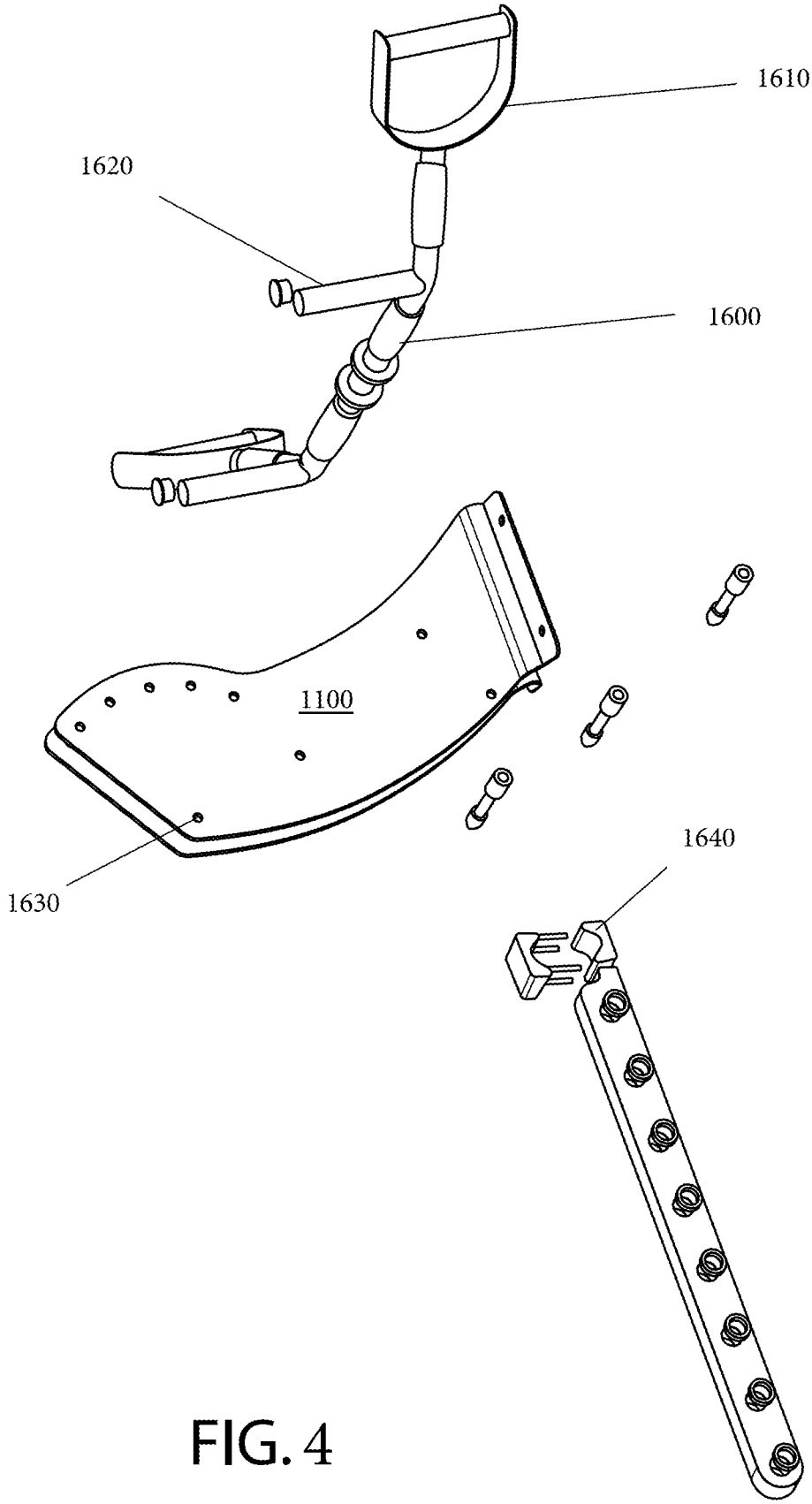
FIG. 4 is an exploded view of the handlebar and trolley assembly of the exercise machine.

Referring to FIG. 2, the key to bi-directional resistance of the exercise machine is the resistance unit. The resistance unit consists of a first flywheel 1400, a second flywheel 1410, a first resistance wheel 1500, a second resistance wheel 1510, a first front pulley 1520, a second front pulley 1521, a rear pulley 1522, a first band 1530, a second band 1531, a first resistance knob 1200 and a second resistance knob 1210, and a pair of recoil systems. In a preferred embodiment, the first and second flywheels 1400, 1410 are magnetic flywheels. FIG. 4 shows the configuration of the resistance unit that provides resistance during a "push" movement. The resistance during the "push" movement is driven by the first flywheel 1400, the first resistance wheel 1500, the first front pulley 1520, the first band, 1530, and the rear pulley 1522. The resistance for the "push" movement, may be adjusted via the first resistance knob 1200, which is in communication with the first flywheel 1400. The resistance during the "pull" movement is driven by the second flywheel 1410, the second resistance wheel 1510, the second front pulley 1521, and the second band 1531. The resistance for the "pull" movement, may be adjusted via the second resistance knob 1210, which is in communication with the second flywheel 1410.

Figure 5:
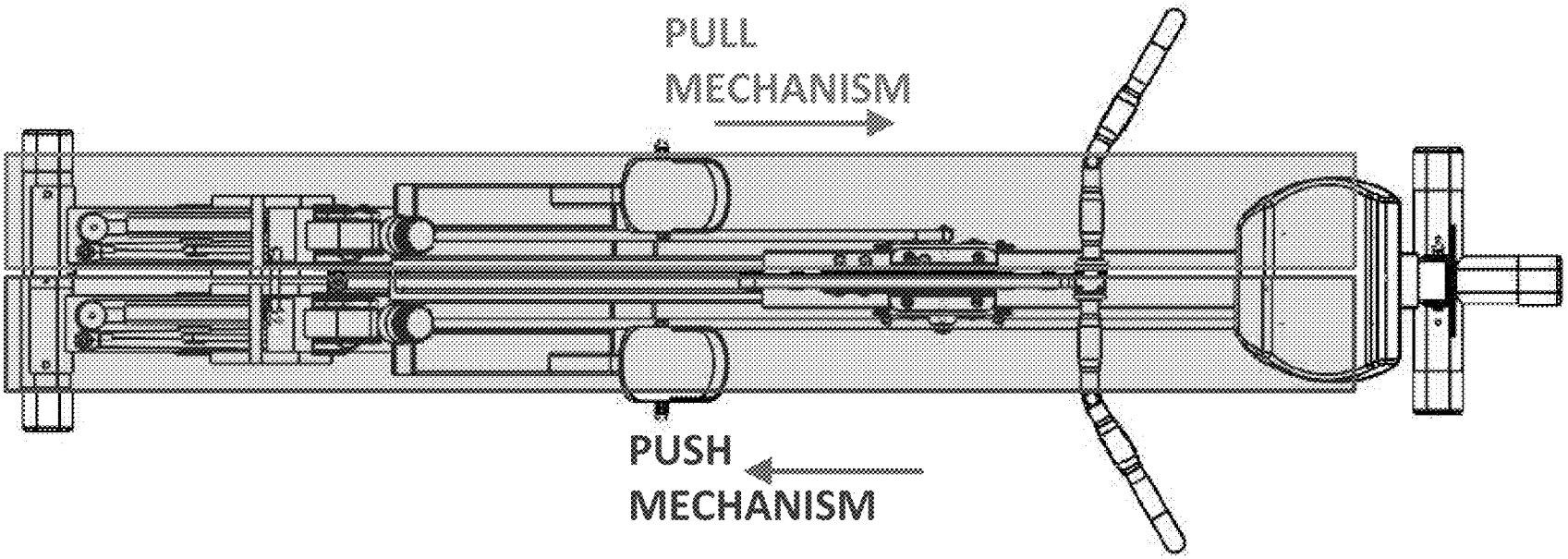
FIG. 5 is an exemplary flow diagram of the exercise machine.

FIG. 5 is a diagram showing how the push and pull resistance mechanisms are configured in relation to the bi-directional exercise machine.

Figure 6:
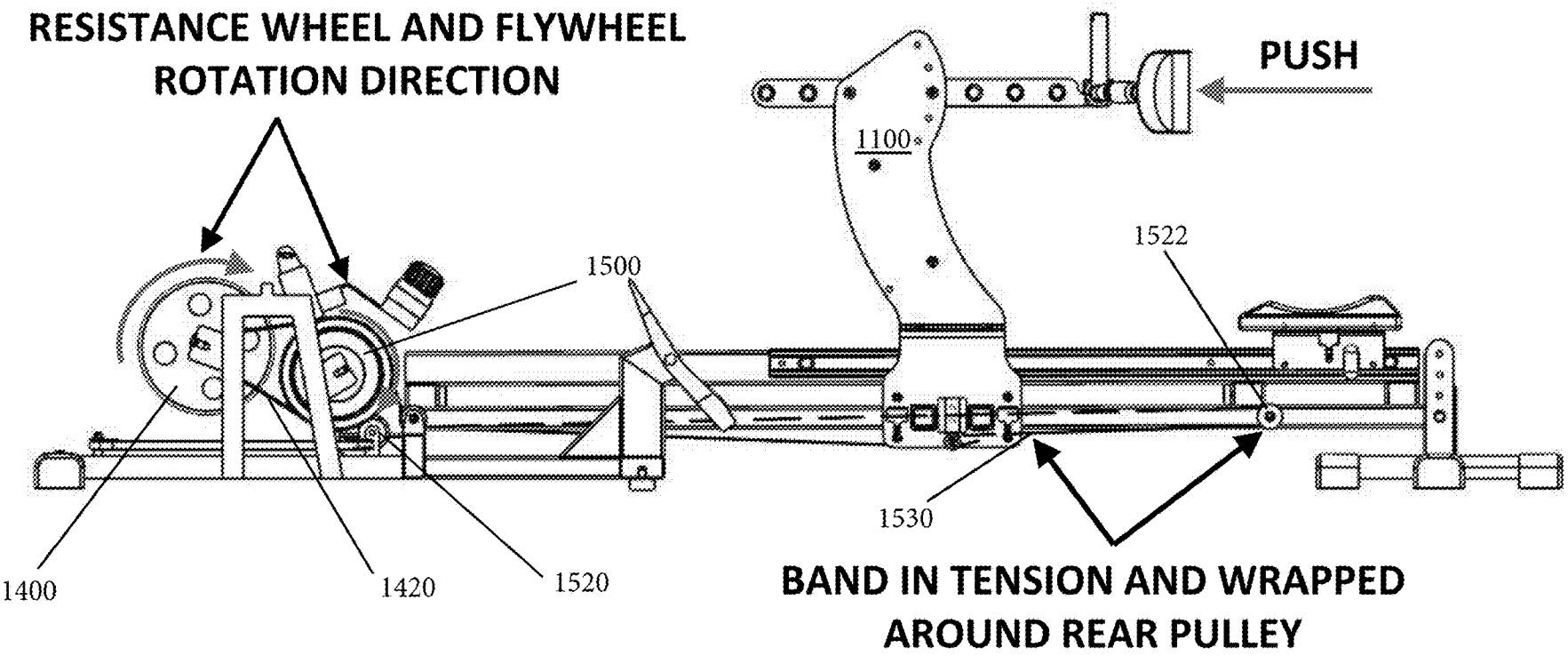
FIG. 6 is exemplary flow diagram of the exercise machine.

FIG. 6 is a schematic diagram of the flow of the resistance wheel and flywheel during the "push" movement. FIG. 6 also shows how the different elements communicate with each other during a "push" movement, wherein the flywheel creates resistance against the user when the user is pushing the trolley 1100 from the back of the exercise machine to the front of the exercise machine. Referring to FIGS. 4 and 6, a first band 1530 is attached to the trolley 1100 on one end and the first band 1530 travels from the trolley 1100 toward the back end of the exercise machine until it reaches and wraps around the rear pulley 1522 and back toward the first front pulley 1520. The band travels along the rails and then it wraps under and up the first front pulley 1520. After the first band 1530 travels under and around the first front pulley 1520, the first band 1530 wraps around a portion of the outer perimeter of the first resistance wheel 1500. To further describe the resistance unit, the first flywheel 1400 is in communication with the first resistance wheel 1500 via a flywheel belt 1420, wherein the flywheel belt 1420 forms a loop around an inner disc 1401 on the first flywheel 1400 and an outer disc 1501 of the first resistance wheel 1500, wherein the rotation of the first resistance wheel 1500 generated from the first band 1530 being moved by the user's pushing of the trolley 1100 rotates the first flywheel 1400 via the flywheel belt 1420.

In use, when the trolley 1100 is being pushed from the back of the exercise machine to the front of the exercise machine, there is tension in the first band 1530, which rotates the first resistance wheel 1500 in a direction toward the trolley 1100, which in turn rotates the first flywheel 1400 in the same direction toward the trolley 1100. In one embodiment, the trolley 1100 features at least two wheels 1110 that allow the trolley to slide along the trolley rail track 2000. In an alternative embodiment, the trolley 1100 may feature a smooth non-friction surface that communicates and slides along the trolley rail track 2000.

Figure 7:
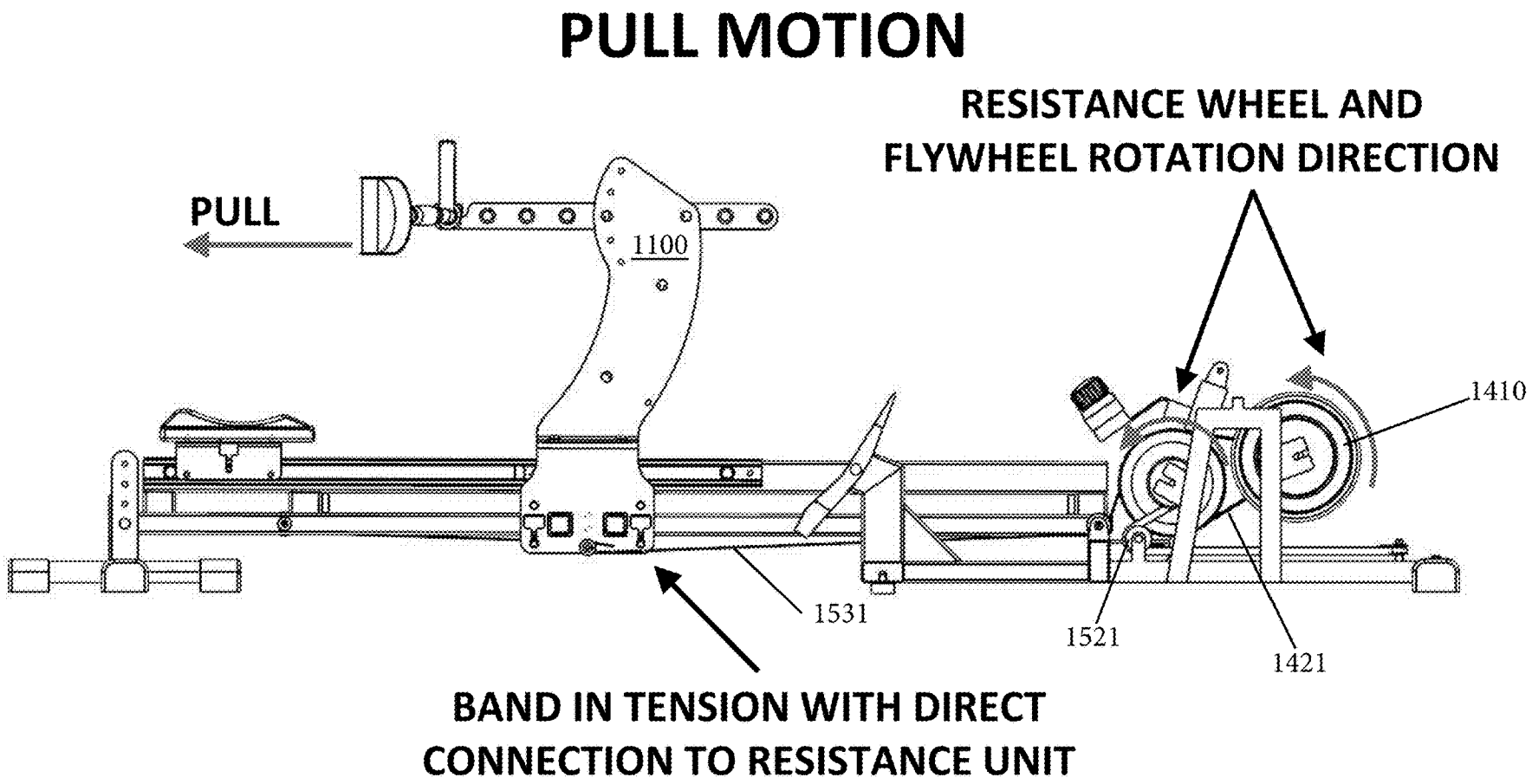
FIG. 7 is exemplary flow diagram of the exercise machine.

FIG. 7 is a flow schematic of the exercise machine during a "pull" movement. FIG. 7 also shows how the different elements communicate with each other during a "pull" movement, wherein the flywheel creates resistance against the user when the user is pulling the trolley 1100 from the front of the exercise machine to the back of the exercise machine. Referring to FIG. 7, on one side of the exercise machine, the second band 1531 is attached to the trolley 1100 on one end and travels towards the resistance unit, wherein the second band 1531 wraps under the second front pulley 1521 and up towards the second resistance wheel 1510, where it is attached to the perimeter of the second resistance wheel 1510. To further describe the resistance unit, the second flywheel 1410 is in communication with the second resistance wheel 1510 via a second flywheel belt 1421, wherein the second flywheel belt 1421 forms a loop around a second inner disc 1402 on the second flywheel 1410 and a second outer disc 1502 of the second resistance wheel 1510, wherein the rotation of the second resistance wheel 1510 generated from the second band 1531 being moved by the user's pulling of the trolley 1100 rotates the second flywheel 1410 via the second flywheel belt 1421.

In use, when the trolley 1100 is being pulled from the front of the exercise machine to the back of the exercise machine, there is tension in the second band 1531 that is in direct connection with the second resistance wheel 1510, wherein the tension and pulling on the second band 1531 rotates the second resistance wheel 1510 in a direction toward the trolley 1100, which in turn rotates the second flywheel 1410 in the same direction toward the trolley 1100.

In one embodiment, the trolley 1100 features at least two wheels that allow the trolley to slide along the trolley rail track 2000. In an alternative embodiment, the trolley 1100 may feature a smooth non-friction surface that communicates and slides along the trolley rail track 2000.

Referring to FIGS. 1, 2, 5, 6, and 7, the exercise machine also features a recoil system. The recoil system features a first recoil rope 2100 that is in communication with an inner wheel of the first resistance wheel 1500 and a second recoil rope 2110 that is in communication with an inner wheel of the second resistance wheel 1510. The recoil system aids in rotating the resistance wheels 1500, 1510 and the flywheels 1400, 1410 back into the starting position after the user has performed a "push" or "pull" movement. The recoil system may be composed of a plurality of recoil pulleys, wherein a the first recoil rope 2100 is fixed to the front of the exercise machine at the base of the exercise machine on the same side as the first flywheel 1400 and first resistance wheel 1500, and it travels toward the first resistance wheel 1500, wraps around a horizontal first recoil pulley 2300 back toward the front of the machine, where it wraps around a horizontal second recoil pulley 2400, and travels back toward the first resistance wheel 1500, wherein the recoil rope wraps around a vertical third recoil pulley 2500 and travels up toward the inner wheel of the first resistance wheel 1500. In the same embodiment, a the second recoil rope 2110 is fixed to the front of the exercise machine at the base of the exercise machine on the same side as the second flywheel 1410 and second resistance wheel 1510, and it travels toward the second resistance wheel 1510, wraps around a horizontal first recoil pulley 2300 back toward the front of the machine, where it wraps around a horizontal second recoil pulley 2400, and travels back toward the second resistance wheel 1510, wherein the recoil rope wraps around a vertical third recoil pulley 2500 and travels up toward the inner wheel of the second resistance wheel 1510. In use, when the bands 1530, 1531 pull the resistance wheels 1500, 1510, they rotate and pull on the recoil ropes 2100, 2110, but the resistance wheels 1500, 1510 cannot reposition on their own, so the recoil ropes 2100, 2110 rotate the resistance wheels 1500, 1510 back to its original opposition.

Figure 8:
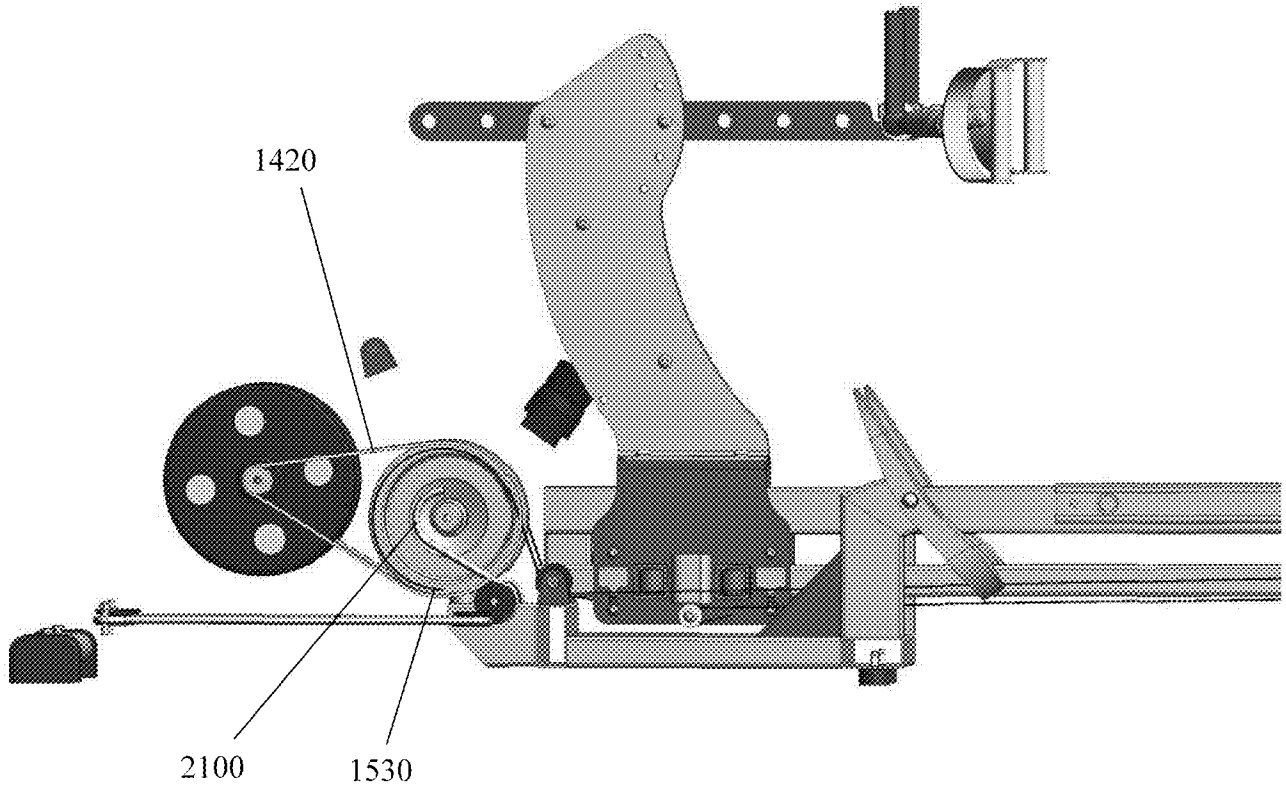
FIG. 8 is an side view of the resistance unit of the exercise machine with certain elements removed to feature the configuration of the resistance unit.

FIG. 8 is an side view of the resistance unit of the exercise machine with certain elements removed to feature the configuration of the resistance unit. Referring to FIG. 8, it is an exemplary embodiment of how the first band 1530 is fixed to a portion of the first resistance wheel 1500 and wraps around a portion of the first resistance wheel 1500 from the first front pulley 1520. FIG. 8 also shows how the first flywheel band 1420 is configured around the center of the first flywheel 1400 and the perimeter of the first resistance wheel 1500. Additionally, FIG. 8 shows the first recoil rope 2100 fixed to a point on the first resistance wheel 1500.

FIG. 4 is an exploded view of the handlebar assembly 1600. Referring to FIG. 4, the handlebar 1600 features both stirrup handle grips 1610 and upright handle grips 1620. In one embodiment, the handlebar connector 1640 secures the handlebar assembly 1600, where it is anchored at the center of its concave shape. Moreover, the handlebar connector 1640 is connected to the trolley 1100 at its distal end via the angle adjustment connector 1630. The angle adjustment connector 1630 fixates the handlebar connector to the trolley 1100 permitting the handlebar connector 1640 to rotate around the angle adjustment connector 1630. In one embodiment, the handlebar 1600 may be angularly adjusted by applying an upward or downward force to the handlebar connector 1400 pole exhibiting the connector opening 1650, initiating a rotation around the angle adjustment connector 1630. Also, in a preferred embodiment, the handlebar connector 1640 may feature a plurality of adjustment holes, wherein the user can adjust the distance between the handlebars 1600 and the seat 1300. In an alternative embodiment, the handlebar assembly 1600 may feature a variety of interchangeable different grips, such as D-Handles, a rope, a flat bar, or other handle attachments.

In use, a user can achieve a full body workout that requires antagonist muscle groups to work in series, wherein the user can perform an efficient workout that results in increased strength. From a starting position with the trolley 1100 at the front of the trolley rail track 2000, the user may start by setting the seat 1300 at a desired distance from the trolley 1100 by pushing the pin through a slot in the seat and through the seat rail track 1900. The user then sits on the seat 1300 and places his or her foot in the foot beds 1700. The user than grips a portion of the handlebar assembly 1600 and pulls the trolley 1100 toward his or her body and toward the back of the exercise machine against the resistance of the second flywheel 1410. This pulling motion works the user's core, legs, back, and biceps. After the user has achieved a full range of motion toward the back of the exercise machine, the user will then push the trolley 1100 back toward the front of the exercise machine against the resistance provided by the first flywheel 1410. This motion works the user's core, chest, triceps and shoulders. If the resistance on the push motion is too low or too high, the user may adjust the first resistance knob 1200. If the resistance on the pull motion is too high or too low, then the user may adjust the second resistance knob 1210. With each pull and push, the user works against a constant resistance, which increases the efficiency of the workout by providing resistance with each motion. Also, because the first and second resistance knobs are independent of each other, a user can have a variable amount of resistance on the "pull" movement that is different than the amount of resistance on the "push" movement, which is an advantage over other machines that require a set amount of weight be set prior to an exercise, wherein a user has to stop and adjust the weight between a back exercise and a chest exercise.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

We claim:

1. A bi-directional resistance exercise machine comprising:

a base with at least one rail track;

a first flywheel connected to a first resistance wheel via a first flywheel belt, whereby the first flywheel and the first resistance wheel are configured to one side of the rail track;

a second flywheel connected to a second resistance wheel via a second flywheel belt;

a rear pulley fixed to one side of the rail track, whereby the rear pulley is on the same side as the first flywheel and first resistance wheel;

a first front pulley fixed to the front of the rail track, whereby the first front pulley is on the same side of the trolley rail track as the first flywheel and first resistance wheel;

a first band that is fixed to a trolley and wraps around the rear pulley and travels back toward the first front pulley, wherein the first band wraps under and up the first front pulley, wherein the first band wraps around the portion of and is fixed to the first resistance wheel;

a second front pulley fixed to the front of the rail track, whereby the second front pulley is on the same side of the trolley rail track as the second flywheel and the second resistance wheel;

a second band that is fixed to the trolley and travels toward the second front pulley, wraps under and up the second front pulley, and wraps around a portion of, and is fixed to, the second resistance wheel; and, a recoil system.

2. The bi-directional resistance exercise machine of claim 1, wherein the first and second flywheels are magnetic flywheels.

3. The bi-directional resistance exercise machine of claim 1, wherein one end of the base features an incline adjustment mechanism.

4. The bi-directional resistance exercise machine of claim 1, wherein the first flywheel is further defined by a resistance knob, whereby a user can adjust the resistance during a push movement.

5. The bi-directional resistance exercise machine of claim 1, wherein the second flywheel is further defined by a resistance knob, whereby a user can adjust the resistance during a pull movement.

6. The bi-directional resistance exercise machine of claim 1, wherein the handlebar assembly is defined by upright grips.

7. The bi-directional resistance exercise machine of claim 1, wherein the handlebar assembly is adjustable in relation to the trolley.

8. The bi-directional resistance exercise machine of claim 1, wherein the handlebar assembly is defined by D-shaped handles.

9. The bi-directional resistance exercise machine of claim 1, wherein the trolley is defined by at least two wheels, whereby the trolley slides along the trolley rail track.

10. The bi-directional resistance exercise machine of claim 1, wherein the recoil system is further defined by a plurality of recoil pulleys.

11. The bi-directional resistance exercise machine of claim 10, wherein the recoil system is further defined by at least one recoil rope.

12. The bi-directional resistance exercise machine of claim 10, wherein the at least one recoil rope is attached to the base on one end and to the first or second resistance wheel on the other end.

13. The bi-directional resistance exercise machine of claim 10, wherein the at least one recoil rope wraps around at least one of the plurality of recoil pulleys.

14. The bi-directional resistance exercise machine of claim 1, wherein the exercise machine is further defined by a seat rail track that features a series of slots, whereby the location of a seat may be adjusted.

15. The bi-directional resistance exercise machine of claim 1, wherein the base is further defined by a foot bed that features an adjustable strap.

16. A method of achieving an antagonistic work out comprising:

obtaining a base with at least one rail track, a slideable trolley configured to slide along a trolley rail track, a first flywheel connected to a first resistance wheel via a first flywheel belt, whereby the first flywheel and the first resistance wheel are configured to one side of the trolley rail track, a second flywheel connected to a second resistance wheel via a second flywheel belt, a rear pulley fixed to one side of the trolley rail track, whereby the rear pulley is on the same side as the first flywheel and first resistance wheel, a first front pulley fixed to the front of the trolley rail track, whereby the first front pulley is on the same side of the trolley rail track as the first flywheel and first resistance wheel, a first band that is fixed to the trolley and wraps around the rear pulley and travels back toward the first front pulley, wherein the first band wraps under and up the first front pulley, wherein the first band wraps around the portion of and is fixed to the first resistance wheel, a second front pulley fixed to the front of the trolley track, whereby the second front pulley is on the same side of the trolley rail track as the second flywheel and the second resistance wheel, a second band that is fixed to the trolley and travels toward the second front pulley, wraps under and up the second front pulley, and wraps around a portion of, and is fixed to, the second resistance wheel, and, a recoil system;

pulling the trolley toward to user's body; and, pushing the trolley away from the user's body.

17. The method of claim 16, wherein the first and second flywheels are magnetic flywheels.

18. The method of claim 16, wherein the bi-directional machine features an incline adjustment mechanism.

19. The method of claim 16, wherein the bi-directional machine features a resistance knob to adjust the resistance.

* * * * *